US008948430B2

(12) United States Patent
Nielsen

(10) Patent No.: US 8,948,430 B2
(45) Date of Patent: Feb. 3, 2015

(54) HEARING AID WITH AN ELONGATE MEMBER

(75) Inventor: Henrik Nielsen, Roskilde (DK)

(73) Assignee: GN Resound A/S, Ballerup (DK)

( * ) Notice: Subject to any disclaimer, the term of this patent is extended or adjusted under 35 U.S.C. 154(b) by 421 days.

(21) Appl. No.: 12/299,101

(22) PCT Filed: Jun. 22, 2007

(86) PCT No.: PCT/DK2007/000306
§ 371 (c)(1),
(2), (4) Date: Mar. 4, 2009

(87) PCT Pub. No.: WO2007/147416
PCT Pub. Date: Dec. 27, 2007

(65) Prior Publication Data

US 2009/0180654 A1 Jul. 16, 2009

Related U.S. Application Data

(60) Provisional application No. 60/816,246, filed on Jun. 23, 2006.

(30) Foreign Application Priority Data

Jun. 23, 2006 (DK) ..... 2006 00853

(51) Int. Cl.
*H04R 25/00* (2006.01)

(52) U.S. Cl.
CPC ..... *H04R 25/656* (2013.01); *H04R 25/604* (2013.01); *H04R 2225/023* (2013.01); *H04R 2225/63* (2013.01); *H04R 25/602* (2013.01); *H04R 25/658* (2013.01)
USPC ..... 381/324; 381/322; 381/328; 381/329

(58) Field of Classification Search
USPC ..... 381/322, 324, 328, 329
See application file for complete search history.

(56) References Cited

U.S. PATENT DOCUMENTS 3,783,201 A * 1/1974 Weiss et al. ..... 381/324
4,553,627 A 11/1985 Gastmeier et al.
5,048,090 A * 9/1991 Geers ..... 381/328

(Continued)

FOREIGN PATENT DOCUMENTS

CH 673551 A5 2/1984
CN 1124003 A 6/1996

(Continued)

OTHER PUBLICATIONS

Office Action dated Mar. 15, 2010 for EP Application No. 07722683.5.

(Continued)

*Primary Examiner* — Matthew E Warren
(74) *Attorney, Agent, or Firm* — Vista IP Law Group, LLP

(57) ABSTRACT

A hearing aid includes a housing for accommodation of a signal processor for processing an audio signal into a processed audio signal compensating a hearing loss, and a receiver that is connected to an output of the signal processor for converting the processed audio signal into a sound signal, wherein the housing extends through a central part of an earpiece part, and is coupled to the earpiece part, the earpiece part configured to be placed in an ear canal of a user.

32 Claims, 11 Drawing Sheets

(56) References Cited

U.S. PATENT DOCUMENTS

| | | | | |
|---|---|---|---|---|
| 5,201,006 | A | 4/1993 | Weinrich | |
| 5,403,262 | A | 4/1995 | Gooch | |
| 5,619,580 | A | 4/1997 | Hansen | |
| 5,654,530 | A | 8/1997 | Sauer et al. | |
| 5,680,467 | A | 10/1997 | Hansen | |
| 5,784,470 | A | 7/1998 | Fackler et al. | |
| 5,889,874 | A | 3/1999 | Schmitt et al. | |
| 6,493,454 | B1 | 12/2002 | Loi et al. | |
| 6,498,858 | B2 | 12/2002 | Kates | |
| 6,532,294 | B1 | 3/2003 | Rdell | |
| 6,704,423 | B2 | 3/2004 | Anderson et al. | |
| 6,940,989 | B1 | 9/2005 | Shennib et al. | |
| 7,130,437 | B2 * | 10/2006 | Stonikas et al. | 381/328 |
| 7,424,124 | B2 * | 9/2008 | Shennib et al. | 381/328 |
| 7,899,200 | B2 | 3/2011 | Karamuk et al. | |
| 2001/0043707 | A1 | 11/2001 | Leedom | |
| 2001/0051776 | A1 | 12/2001 | Lenhardt | |
| 2004/0047483 | A1 | 3/2004 | Bauman | |
| 2004/0096075 | A1 | 5/2004 | Kuhlmann et al. | |
| 2004/0131200 | A1 | 7/2004 | Davis | |
| 2004/0258264 | A1 | 12/2004 | Jorgensen et al. | |
| 2005/0078843 | A1 * | 4/2005 | Bauman | 381/312 |
| 2005/0190940 | A1 * | 9/2005 | Ach-Kowalewski et al. | 381/330 |
| 2006/0050914 | A1 * | 3/2006 | Urso et al. | 381/328 |
| 2006/0147072 | A1 * | 7/2006 | Sodoma et al. | 381/328 |
| 2006/0239483 | A1 | 10/2006 | Orts et al. | |
| 2007/0036374 | A1 | 2/2007 | Bauman | |

FOREIGN PATENT DOCUMENTS

| | | | |
|---|---|---|---|
| DE | 8328154 | U1 | 2/1984 |
| DE | 29801567 | U1 | 4/1998 |
| DE | 19706306 | C1 | 10/1998 |
| DE | 29718483 | U1 | 2/1999 |
| DE | 29718503 | U1 | 4/1999 |
| DE | 29916891 | U1 | 3/2000 |
| EP | 0368125 | A2 | 5/1990 |
| EP | 1448014 | A1 | 8/2004 |
| EP | 1 599 069 | A1 | 11/2005 |
| EP | 1594340 | A | 11/2005 |
| EP | 1653776 | | 5/2006 |
| GB | 2134689 | A | 8/1984 |
| JP | 05-199590 | A | 8/1993 |
| JP | 10-512116 | A | 11/1998 |
| JP | 2000-506697 | A | 5/2000 |
| JP | 2003-511940 | A | 3/2003 |
| JP | 2004-229181 | A | 8/2004 |
| WO | 9621334 | A1 | 7/1996 |
| WO | 9734443 | A1 | 9/1997 |
| WO | 9851125 | A | 11/1998 |
| WO | 00/32009 | | 6/2000 |
| WO | 0076271 | A | 12/2000 |
| WO | 0108443 | A2 | 2/2001 |
| WO | 0128289 | A1 | 4/2001 |
| WO | 0203757 | A1 | 1/2002 |
| WO | 02052890 | A1 | 7/2002 |
| WO | 2004010734 | A1 | 1/2004 |
| WO | 2004036953 | | 4/2004 |
| WO | 2007147415 | A1 | 12/2007 |

OTHER PUBLICATIONS

Written Opinion of the International Search Authority for PCT/DK2007/000305.
International Preliminary Report on Patentability and Written Opinion of the International Search Authority for PCT/DK2007/000307.
International Preliminary Report on Patentability and Written Opinion of the International Search Authority for PCT/DK2007/000306.
Office Action dated Jan. 11, 2012 for CN Application No. 200780030352.X.
Pawel J. Jastreboff, "Tinnitus Habituation Therapy (THT) and Tinnitus Retraining Therapy (TRT)", In Tyler RS, ed. Handbook of Tinnitus. San Diego: Singular Publishing; 2000:357-375.
Luca Del Bo et al, "Using Open-Ear Hearing Aids in Tinnitus Therapy", Hearing Review, Aug. 2006.
Notice of Allowance and Fee(s) Due dated Aug. 17, 2012, for U.S. Appl. No. 12/278,241.
Notice of Allowance and Fee(s) Due dated Aug. 21, 2012, for U.S. Appl. No. 12/186,370.
Advisory Action dated Sep. 4, 2012, for U.S. Appl. No. 12/299,047.
Notice of Allowance and Fees Due dated Oct. 4, 2012, for U.S. Appl. No. 12/186,370.
Corrected Notice of Allowability dated Oct. 2, 2012, for U.S. Appl. No. 12/278,241.
Corrected Notice of Allowability dated Oct. 31, 2012, for U.S. Appl. No. 12/278,241.
Corrected Notice of Allowability dated Nov. 6, 2012, for U.S. Appl. No. 12/186,370.
Non-Final Office Action dated Oct. 17, 2011, for U.S. Appl. No. 12/299,047.
Final Office Action dated Apr. 19, 2012, for U.S. Appl. No. 12/299,047.
Non-Final Office Action dated Aug. 18, 2011, for U.S. Appl. No. 12/278,241.
Final Office Action dated Feb. 16, 2012, for U.S. Appl. No. 12/278,241.
Advisory Action dated Apr. 25, 2012, for U.S. Appl. No. 12/278,241.
Non-Final Office Action dated Aug. 16, 2011, for U.S. Appl. No. 12/186,370.
Final Office Action dated Jan. 18, 2012, for U.S. Appl. No. 12/186,370.
Notice of Allowance and Fee(s) Due dated Jul. 20, 2012, for U.S. Appl. No. 12/278,241.
Office Action dated Jul. 10, 2012 for JP Patent Application No. 2009-515705.
English Translation of the Office Action dated Jul. 10, 2012 for JP Patent Application No. 2009-515705.
Office Action dated Jul. 10, 2012 for JP Patent Application No. 2009-515706.
English Translation of the Office Action dated Jul. 10, 2012 for JP Patent Application No. 2009-515706.
Office Action dated Jul. 10, 2012 for JP Patent Application No. 2009-515707.
English Translation of the Office Action dated Jul. 10, 2012 for JP Patent Application No. 2009-515707.
Machine English Translation of JP 05199590 dated Aug. 6, 1993.
Final Office Action dated Feb. 5, 2013, for JP Patent Application No. 2009-515705.
Notice of Allowance and Fees Due dated Sep. 12, 2013 for U.S. Appl. No. 12/299,047.
Advisory Action dated Nov. 26, 2012, for U.S. Appl. No. 12/299,101.
Japanese Office Action dated Oct. 1, 2013 for related JP Patent Application No. 2009-515706, 3 pages.
European Office Action dated Nov. 6, 2013 for related EP Patent Application No. 07 722 682.7, 5 pages.
Non-final Office Action dated Jun. 19, 2014, for U.S. Appl. No. 13/764,751.
Japanese Office Action dated May 27, 2014 for related JP Patent Application No. 2013-123793, 7 pages.

* cited by examiner

A

B

HEARING AID WITH AN ELONGATE MEMBER

RELATED APPLICATION DATA

This application is the national stage of International Application No. PCT/DK2007/000306, filed on Jun. 22, 2007, which claims priority to and the benefit of Denmark Patent Application No. PA 2006 00853, filed on Jun. 23, 2006, and U.S. Provisional Patent Application No. 60/816,246, filed on Jun. 23, 2006, the entire disclosure of all of which is expressly incorporated by reference herein.

This application is related to U.S. patent application Ser. No. 12/278,241.

FIELD

The present application relates to a new type of hearing aid with a housing that is adapted for positioning in the ear canal of a user.

BACKGROUND

A conventional in the ear (ITE) or completely-in-the-canal (CIC) hearing aid has a housing that is custom made to individually fit the user's ear canal. The hearing aid components, e.g. electronics, microphone, receiver, battery, etc., are contained in the housing which is dosed by a faceplate at the end pointing away from the ear canal. In order to reduce occlusion, a so-called vent, i.e. a ventilation channel, is provided for communication between an opening in the faceplate and the user's ear canal. The vent may be drilled through the housing or shell, or a pipe or tube extending within the hearing aid and connecting an opening in the faceplate with an opening at the opposite end of the housing may constitute the vent. The effectiveness of the vent is increased by increasing the cross-section and decreasing the length of the vent channel.

Behind-the-ear (BTE) hearing aids in which a sound tube conducts sound generated by the receiver of the hearing aid into the ear canal are also well known in the art. In order to position the sound tube securely and comfortably in the ear canal, an earpiece is provided for insertion into the ear canal of the user.

Typically, the ITE or CIC housing or the BTE earpiece is individually custom manufactured to fit precisely in the ear canal of the user without causing pain to the user while still retaining the housing or earpiece securely in place in the ear canal preventing the earpiece from falling out of the ear irrespective of movements of the user, such as chewing or yawning, and also avoiding acoustical feedback generating unpleasant and annoying whistling or howling. The custom made earpiece adds to the cost of the hearing aid and the time needed to fit the hearing aid.

Typically, customized hearing aids are made from solid materials to secure retention and tightness. These hearing aids are placed completely or partially in the ear canal. Since the walls of the ear canal are moving when the jaws move for instance when chewing, the placement of such solid devices in the ear canal can be associated with discomfort for the user.

Several approaches to eliminate this discomfort have been tried, one such approach is to make the canal portion of the device in a soft material, e.g. as disclosed in WO 02/03757 A1. Such devices are complicated to manufacture and will only offer limited venting.

In WO 2004/010734, a canal hearing device is disclosed having a dual acoustic seal system for preventing feedback while minimizing occlusion effects. The two-part device comprises a main module and an elongated tubular insert for conducting sound to the eardrum and sealing within the bony region of the ear canal. The main module is positioned in the cartilaginous portion of the ear canal. The tubular insert comprises a sound conduction tube and a cylindrically hollow primary seal medially positioned in the bony region. The device also comprises a secondary seal laterally positioned in the cartilaginous region.

WO 01/08443 discloses a one-size-fits-all hearing aid, which is adapted to fit into either ear of an ear canal of a user to a depth proximal to the tympanic membrane. The hearing aid is comprised of two half shells joined together to house the hearing aid components. The joined shells secure a flexible tip at the distal end of the shell.

SUMMARY

It is an object to provide a hearing aid wherein a part of the hearing aid can be securely and comfortably positioned and retained inside the ear canal of a user similar to the housing of a CIC hearing aid.

It is another object to provide the hearing aid in standard sizes eliminating the need for customization.

According to some embodiments, the above and other objects are fulfilled by a hearing aid with a housing for accommodation of a signal processor for processing an audio signal into an audio signal compensating a hearing loss and a receiver that is connected to an output of the signal processor for converting the processed compensated audio signal into a sound signal. The housing is attached to an earpiece part adapted for positioning in the ear canal of the user in such a way that the housing extends through a central part of the earpiece part.

The housing may be attached to an elongate member adapted for positioning in the pinna and outside the ear canal of the user.

The elongate member has a first end attached to the housing and an opposite second end.

In accordance with hearing aid terminology, the housing is denoted an open housing, when the housing does not obstruct the ear canal when it is positioned in its intended operational position in the ear canal. In an open housing, there will be a passageway between a part of the ear canal wall and a part of the housing so that sound waves may escape from behind the housing between the ear drum and the housing through the passageway and the earpiece part to the surroundings of the user. In this way, the occlusion effect is diminished and preferably substantially eliminated.

The first thing that people being fitted with a hearing aid note is usually the change of their voice. They typically describe the sound of their own voice in one of the following terms: "My voice echoes". "My voice sounds hollow" or "I sound like I'm talking in a barrel". Their altered perception of their own voice is mainly due to occlusion of the ear canal by the housing or earpiece.

Sounds originating from the vocal tract (throat and mouth) are transmitted into the ear canal through the cartilaginous tissue between these cavities and the outer portion of the ear canal.

When nothing is positioned in the ear canal, most of this predominantly low frequency sound simply escapes from the ear canal. However, when the ear canal is blocked these bone-conducted sounds cannot escape from the ear canal. The result is a build-up of high sound pressure levels in the residual ear canal volume. This increase in low frequency sound pressure is audible and will cause them to hear their own voice as loud and boomy. Change in perception of own voice is the most dominant occlusion related complaint, but not the only one. Other occlusion related problems include too much amplification at low frequencies for hearing aid users with good low frequency hearing, reduced speech intelligibility, poorer localization, physical discomfort and increased risk of external ear irritation and infection. Hearing aid users do not adapt to occlusion and the occlusion effect has been cited by as many as 27% of hearing aid wearers as a reason for dissatisfaction with their hearing aids. This emphasizes the need for alleviating or, even better, eliminating the occlusion effect.

A hearing aid comprises a microphone for converting sound into an audio signal, a signal processor for processing the audio signal into an audio signal compensating a hearing loss, and a loudspeaker that is connected to an output of the signal processor for converting the processed compensated audio signal into a sound signal. Further, the hearing aid comprises a battery for power supply of the electric components of the hearing aid.

In accordance with hearing aid terminology, the loudspeaker is also denoted a receiver throughout the present specification.

In one embodiment, the housing accommodates the above-mentioned hearing aid components including the microphone in a way similar to the housing of a CIC hearing aid. In another embodiment, the elongate member accommodates the microphone at its second end and the housing accommodates the other components, and signal conductors extend within the elongate member for electrical interconnection of the microphone with other components in the hearing aid housing.

In one embodiment, the housing and the elongate member form an integral member that is manufactured in one piece.

In another embodiment, the elongate member and the housing form separate units that are manufactured in separate pieces.

In yet another embodiment, the housing and the elongate member are manufactured as separate parts that are interconnected mechanically and possibly electrically during manufacture of the hearing aid.

The housing is preferably manufactured in a number of standard sizes to fit the human anatomy of the ear canal of most users. In this way, the manufacturing cost is lowered as compared to the manufacturing cost of customized housings.

The elongate member is preferably manufactured in a number of standard sizes to fit the human anatomy of the pinna of most users. In this way, the manufacturing cost is lowered as compared to the manufacturing cost of customized elongate members.

In a preferred embodiment, the elongate member is removably interconnected with the housing so that a large number of different models of the hearing aid may be provided by combining elongate members of different standard sizes with housings of different standard sizes.

The housing may comprise a battery door providing access to a battery compartment. The elongate member may be attached to the battery door and the battery door may be removably attached to the housing with a connector for removal of the elongate member from the housing together with the battery door.

The connector may further be adapted for making electrical contact with a signal line in the elongate member when the battery door is attached to the housing.

In one embodiment, the elongate member is adapted to be positioned in the pinna of the user around the circumference of the conchae abutting the antihelix and at least partly covered by the antihelix for retainment of its position.

The elongate member may be preformed during manufacture, preferably into an arched shape with a curvature slightly larger than the curvature of the antihelix, for easy fitting of the elongate member into its intended position in the pinna.

The elongate member may be resilient for assisting in retaining the housing in the ear canal of the user so that the housing remains securely in place in the ear canal without falling out of the ear irrespective of movements of the user, such as chewing or yawning. Retention is provided without causing pain to the user.

The elongate member may further be adapted to abut part of the concha at the antitragus when the housing has been inserted in the ear canal thereby applying a force to the housing towards the ear canal retaining the housing in a position in which the housing is pressed against an anatomical feature within the ear canal.

Retention of the hearing aid in the proper place is important. Jaw movements can exert outward forces on the canal portion of the hearing aid. In an embodiment, the elongate member has sufficient resilience to counteract this force and sufficiently securing the hearing aid from outward motion.

Preferably, the elongate member is resilient in a direction perpendicular to its longitudinal extension thereby providing further capability of retention of the housing in the ear canal of the user. During positioning of the housing in its intended position in the ear canal of the user, the transverse resilience of the elongate member facilitates insertion of the housing into the ear canal of the user.

Preferably, the elongate member is adapted to abut the antihelix and extend at least to the inferior crus of the antihelix when the housing is positioned in the ear canal of the user.

More preferred the elongate member is adapted for positioning of the second end at the cimba concha below the triangular fossa of the ear of the user when the housing is positioned in the ear canal of the user.

The elongate member may be adapted for accommodation of a microphone at the second end. The elongate member may have a larger cross-section at the second end accommodating the microphone than a remaining part of the elongate member extending therefrom and towards the first end.

Positioning of the microphone of the hearing aid at the second end of the elongate member provides a large distance between the microphone and the receiver thereby minimizing feedback.

Feedback limits the maximum gain available to the user of the hearing aid. Feedback refers to the amplified sound returning to the hearing aid microphone from the hearing aid output port mainly through the passageway between the housing and the ear canal wall. Oscillation arises when the attenuation provided by the feedback path is smaller than the hearing aid gain. A large distance between the microphone and the receiver alleviates this problem.

As further described below, electronic feedback suppression may also be provided in the hearing aid according to some embodiments.

The elongate member may accommodate further electrical hearing aid components. In an embodiment with a microphone at the second end of the elongate member, the elongate member is preferably substantially rigid in the direction of its longitudinal extension so that electrical conductors residing in the elongate member are protected against breaking.

With a microphone in the elongate member at its second end, localisation is substantially maintained when the microphone is positioned at a location within the pinna wherein the microphone receives a sound signal that allows the user to perceive the direction towards a sound source. Then, the sound signal based on which the user is capable of perceiving direction is transmitted to the ear drum of the user by the hearing aid. For example, sense of direction may be substantially maintained when the microphone is positioned at the cimba concha below the triangular fossa in the pinna.

Two microphones may be accommodated at the second end of the elongate member for provision of noise suppression and/or further directionality.

In a preferred embodiment, the housing forms an angle along its longitudinal extension facilitating accommodation of the housing in the ear canal of the user.

Preferably, the housing is flexible for variation of the angle for accommodation of the housing to different angles of different users.

Preferably, the housing is flexible for comfortable accommodation of the housing in the ear canal of the user providing a high level of comfort.

The hearing aid may further comprise a cerumen filter that is adapted to be fitted on a loudspeaker with a snap on coupling.

The housing may have a cross-section that is smaller than the cross-section of the ear canal so that occlusion substantially does not occur. When the housing is inserted into the user's ear canal, the smaller cross-section of the housing allows communication between the ear canal between the eardrum and the housing and the surroundings for prevention of occlusion.

The housing may comprise a vent. When the housing is inserted into the user's ear canal, the vent provides communication between the ear canal between the eardrum and the housing and the surroundings for prevention of occlusion. The vent may be a tube that extends through the housing providing communication between the earcanal behind the housing and the outer ear. The tube may have a substantially circular or elliptical cross-section.

The housing may be combined with a flexible earpiece part in such a way that the housing extends through a central part of the flexible earpiece part and is attached to the earpiece part. The flexible earpiece part may be of the type disclosed in EP 1 594 340.

The flexible earpiece part is adapted for positioning in the ear canal of the user and may comprise a base that is connected to the housing, the housing extending through the base, and at least one sidewall that is attached to the base and has an edge that extends substantially from the base to an opening of the earpiece part. The width of the opening fits within the ear canal of the user. The ear piece wall abuts the ear canal wall for retention of the housing in the ear canal, whereby the housing does not touch the ear canal wall for maximum comfort of the user.

The base of the earpiece part is sufficiently rigid and thick to carry and support the attached housing and earpiece part sidewall without being deformed. The sidewall is made from a thin sheet of a soft and flexible material and it functions to hold the housing in an intended position within the ear canal of the user. In this position, the base does not touch the ear canal wall. The edge allows the sidewall to adjust to the size and shape of the user's ear canal since the edge may be displaced along the surface of the ear canal when the earpiece part is being inserted against the ear canal wall. The circumferential displacement of the edge allows the sidewall to adjust to the shape and size of the user's ear canal without wrinkling and loosing contact with the ear canal so that undesirable leaks do not occur.

Preferably, the sidewall of the earpiece part has a generally conical shape. Thus, the earpiece part fits ear canals with a cross-section ranging between the smallest and largest cross sections of the conical sidewall. Thereby, the earpiece part may fit into a wide range of sizes of ear canals.

The conical shape may have a substantially elliptical cross-section. This is advantageous, as most ear canals are, more or less, oval or elliptical in shape. Thus, the earpiece part will fit well and will also be easier for the user to insert in an optimal position in the ear canal.

Furthermore, the base may comprise a vent. When the earpiece part is inserted into the user's ear canal, the vent provides communication between the ear canal behind the base of the earpiece part and the surroundings. The vent opening may be a hole in the base having a substantially circular or elliptical shape. Thereby, occlusion is prevented and the user may furthermore be able to receive sound bypassing the hearing device processing, i.e. natural sound. The latter is often desirable e.g. in headsets, headphones, or hearing aids when the user has a limited hearing impairment, such as in the high frequency range. In this case, the user may hear low frequency sounds very well and therefore does not need the hearing device to process these signals.

The earpiece part is preferably moulded as an integral unit. A highly suitable material is silicone.

In another embodiment, the earpiece part disclosed above is substituted by a customized part for positioning and retention of the housing in the ear canal of the user.

In a preferred embodiment, electronic feedback compensation is provided. Feedback is a well-known problem in hearing aids and several systems for suppression and cancellation of feedback exist within the art. With the development of very small digital signal processing (DSP) units, it has become possible to perform advanced algorithms for feedback suppression in a tiny device, such as a hearing aid, see e.g. U.S. Pat. No. 5,619,580, U.S. Pat. No. 5,680,467 and U.S. Pat. No. 6,498,858.

The above mentioned prior art systems for feedback cancellation in hearing aids deal with external feedback. i.e. transmission of sound between the loudspeaker (often denoted receiver) and the microphone of the hearing aid along a path outside the hearing aid device. This problem, which is also known as acoustical feedback, occurs e.g. when a hearing aid earpiece part does not completely fit the user's ear, or in the case of an earpiece part comprising a vent. In both examples, sound may "leak" from the receiver to the microphone and thereby cause feedback.

The problem of external feedback limits the maximum gain available in a hearing aid.

Thus, the hearing aid may further comprise a feedback compensation circuit for providing a feedback compensation signal of signals picked up by the microphone by modelling an acoustical and mechanical feedback signal path of the hearing aid, subtracting means for subtracting the feedback compensation signals from the audio signal to form a compensated audio signal, which is input to the signal processor of the hearing aid.

The feedback signal path is typically an acoustic path between the microphone and the receiver, i.e. an external feedback signal propagates through air surrounding the hearing aid.

Preferably, the feedback compensation means comprises an adaptive filter, i.e. a filter that changes its impulse response in accordance with changes in the feedback path.

Both static and adaptive filters are well known to a person skilled in the art of hearing aids, and will therefore not be discussed in further detail here.

Tinnitus is the perception of sound in the human ear in the absence of corresponding external sound(s). Tinnitus is considered a phantom sound, which arises in the auditory system. For example, a ringing, buzzing, whistling, or roaring sound may be perceived as tinnitus. Tinnitus can be continuous or intermittent, and in either case can be very disturbing, and can significantly decrease the quality of life for one who has such an affliction.

Tinnitus is not itself a disease but an unwelcome symptom resulting from a range of underlying causes, including psychological factors such as stress, disease (infections, Menieres Disease, Oto-Scierosis, etc.), foreign objects or wax in the ear and injury from loud noises. Tinnitus is also a side-effect of some medications, and may also result from an abnormal level of anxiety and depression.

The perceived tinnitus sound may range from a quiet background sound to a signal loud enough to drown out all outside sounds. The term 'tinnitus' usually refers to more severe cases. A 1953 study of 80 tinnitus-free university students placed in a soundproofed room found that 93% reported hearing a buzzing, pulsing or whistling sound. However, it must not be assumed that this condition is normal—cohort studies have demonstrated that damage to hearing from unnatural levels of noise exposure is very widespread.

Tinnitus cannot be surgically corrected and since, to date, there are no approved effective drug treatments, so-called tinnitus maskers have become known. These are small, battery-driven devices which are wom like a hearing aid behind or in the ear and which, by means of artificial sounds which are emitted, for example via a hearing aid speaker into the auditory canal, to thereby psycho acoustically mask the tinnitus and thus reduce the tinnitus perception.

The artificial sounds produced by the maskers are often narrow-band noise. The spectral position and the loudness level of the noise can often be adjusted via for example a programming device to enable adaptation to the individual tinnitus situation as optimally as possible. In addition, so-called retraining methods have been developed, for example tinnitus retraining therapy (Jastreboff P J. Tinnitus habituation therapy (THI) and tinnitus retraining therapy (TRT). In: Tyler R S, ed. Handbook of Tinnitus. San Diego: Singular Publishing; 2000:357-376) in which, by combination of a mental training program and presentation of broad-band sound (noise) near the auditory threshold, the perceptibility of the tinnitus in quiet conditions is likewise supposed to be largely suppressed. These devices are also called "noisers" or "sound enrichment devices". Such devices or methods are for example known from DE 29718 503, GB 2 134 689, US 2001/0051776, US 2004/0131200 and U.S. Pat. No. 5,403,262.

Although present day tinnitus maskers to a certain extent may provide immediate relief of tinnitus, the masking sound produced by them may adversely affect the understanding of speech, partly because S/N (Speech/Noise) ratio would be lower due to the addition of noise, and partly because persons suffering from tinnitus often also suffer from a reduced ability to understand speech in noise as compared to people with normal hearing.

For many people, the known maskers will not provide any long term relief of tinnitus. Recent research conducted by Del Bo, Ambrosetti, Bettinelli, Domenichetti, Fagnani, and Scotti "Using Open-Ear Hearing Aids in Tinnitus Therapy", Hearing Review, August 2006, has indicated that better long term effects for tinnitus relief may be achieved if so-called habituation of tinnitus is induced in a tinnitus sufferer by using sound enrichment by sound from the ambient environment. The rationale behind habituation relies on two fundamental aspects of brain functioning: Habituation of the reaction of the limbic and sympathetic system, and habituation of sound perception allowing a person to ignore the presence of tinnitus. While tinnitus maskers emit sounds that either partly or completely cover the perceived sound of tinnitus, Del Bo, Ambrosetti, Bettinelli, Domenichetti, Fagnani, and Scotti suggest the use of environmental sounds amplified by a hearing aid or by application of artificial sounds, such as band limited noise. According to an aspect, the hearing aid also includes a tinnitus relieving circuit, for example generating sounds useful for relieving tinnitus as described above. The relieving circuit may for example be a tinnitus masker, a sound enrichment circuit, etc.

According to another aspect, a tinnitus relieving device is provided with a housing and an elongate member as disclosed throughout the present disclosure. The tinnitus relieving device does hot have a microphone. In one embodiment, the tinnitus relieving device does not compensate for a hearing loss.

In accordance with some embodiments, a hearing aid includes a housing for accommodation of a signal processor for processing an audio signal into a processed audio signal compensating a hearing loss, and a receiver that is connected to an output of the signal processor for converting the processed audio signal into a sound signal, wherein the housing extends through a central part of an earpiece part, and is coupled to the earpiece part, the earpiece part configured to be placed in an ear canal of a user. In accordance with other embodiments, a flexible earpiece part for positioning completely in an ear canal of a user includes a base with a first opening for accommodation of a hearing aid housing that extends through the first opening, and at least one sidewall that is attached to the base and has an edge that extends substantially from the base to a second opening of the earpiece, the width of the second opening being less than a width of the ear canal of the user when the at least one sidewall is inside the ear canal.

DESCRIPTION OF DRAWING FIGURES

The above and other features and advantages will become more apparent to those of ordinary skill in the art by describing in detail exemplary embodiments thereof with reference to the attached drawings in which.

Figure 3:
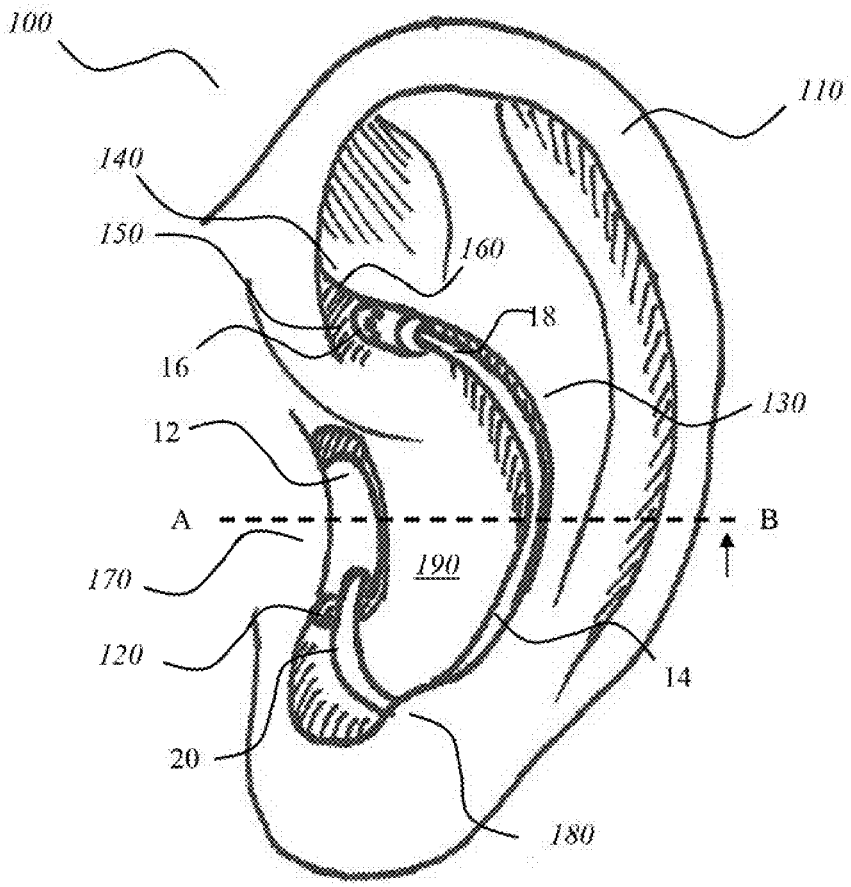
FIG. 3 shows a second embodiment positioned in an ear of a user.
Figure 4:
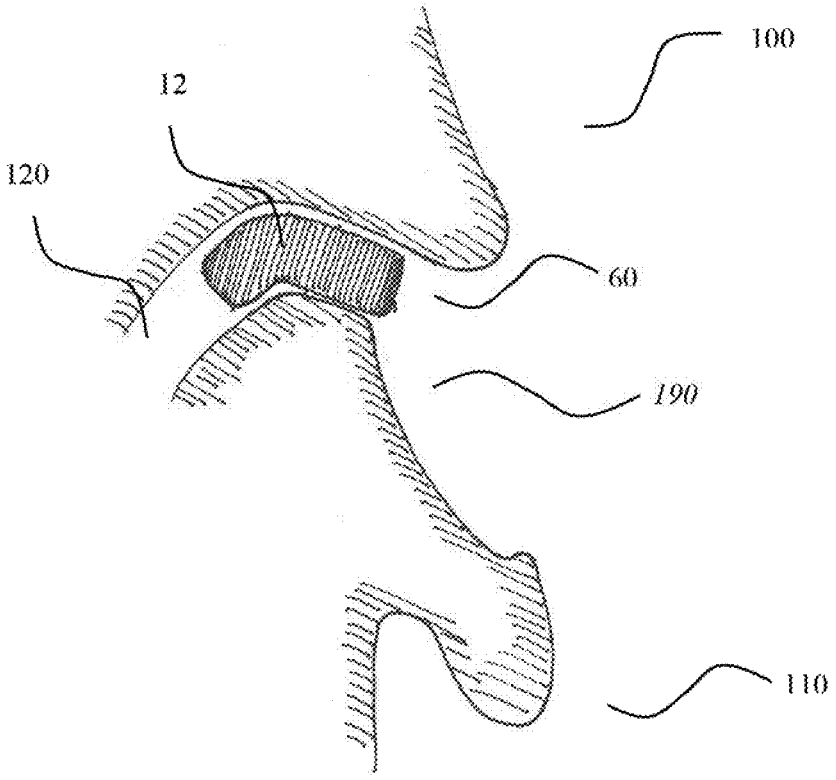
Figure 5:
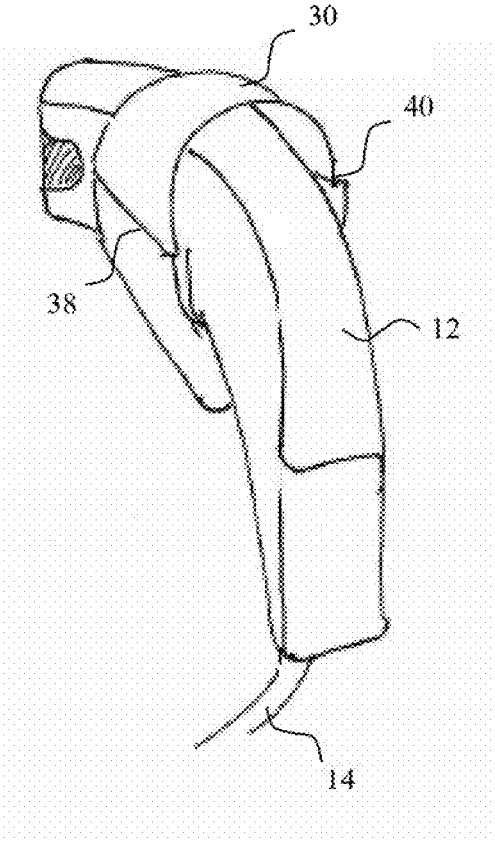
Figure 6:
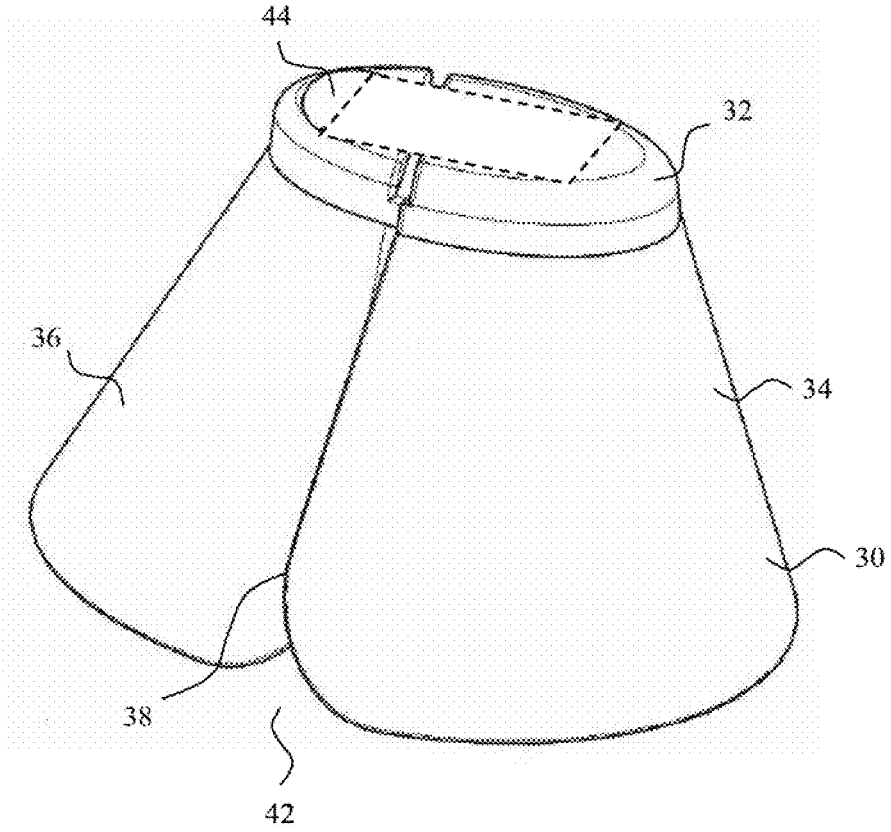
Figure 7:
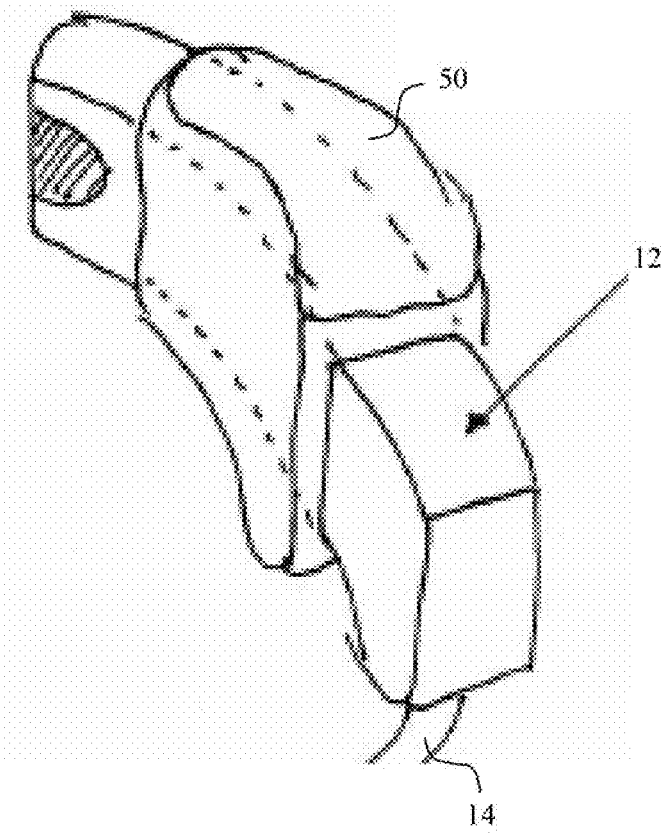
Figure 8:
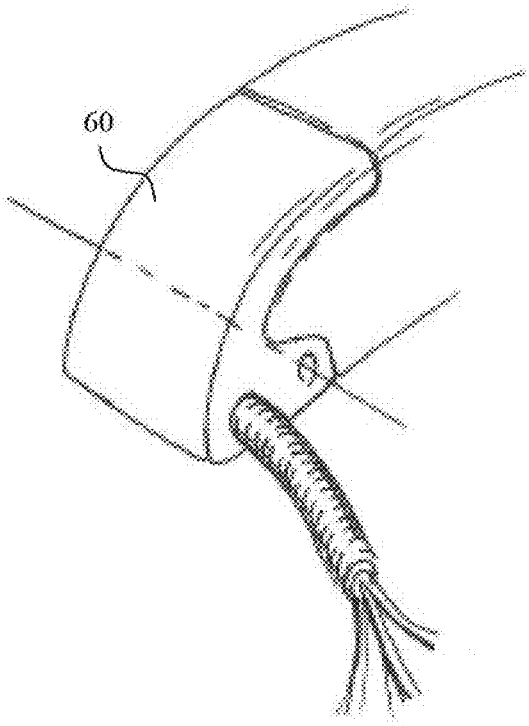
Figure 9:
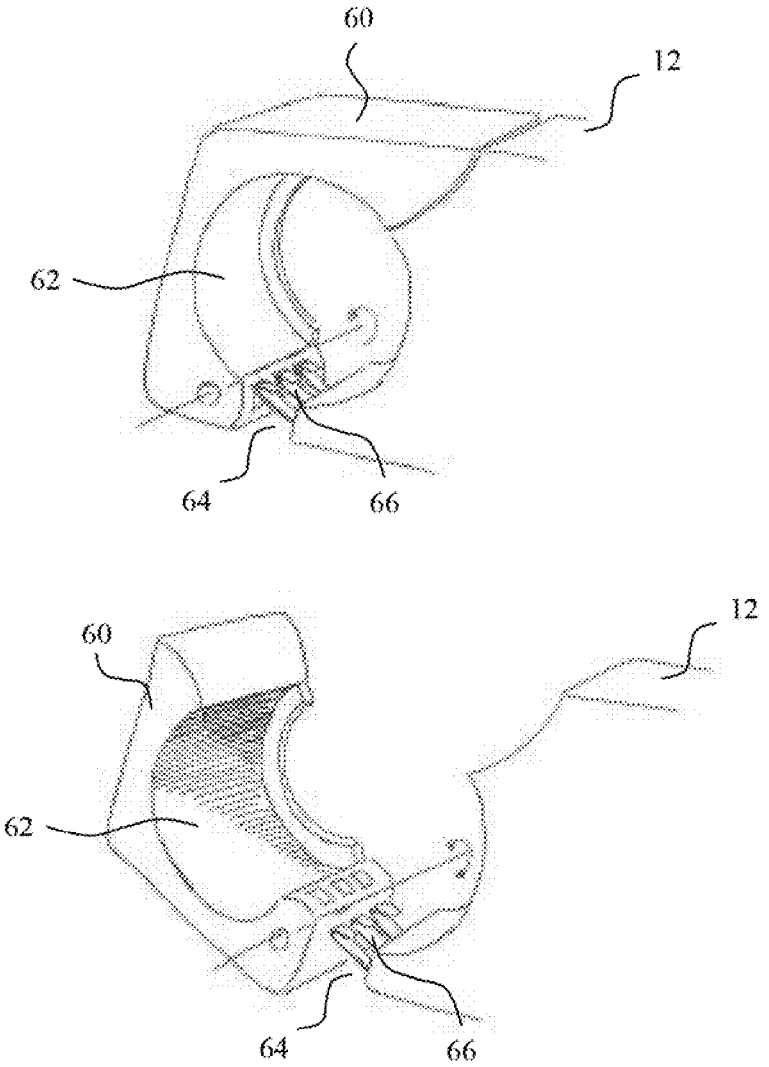
Figure 10:
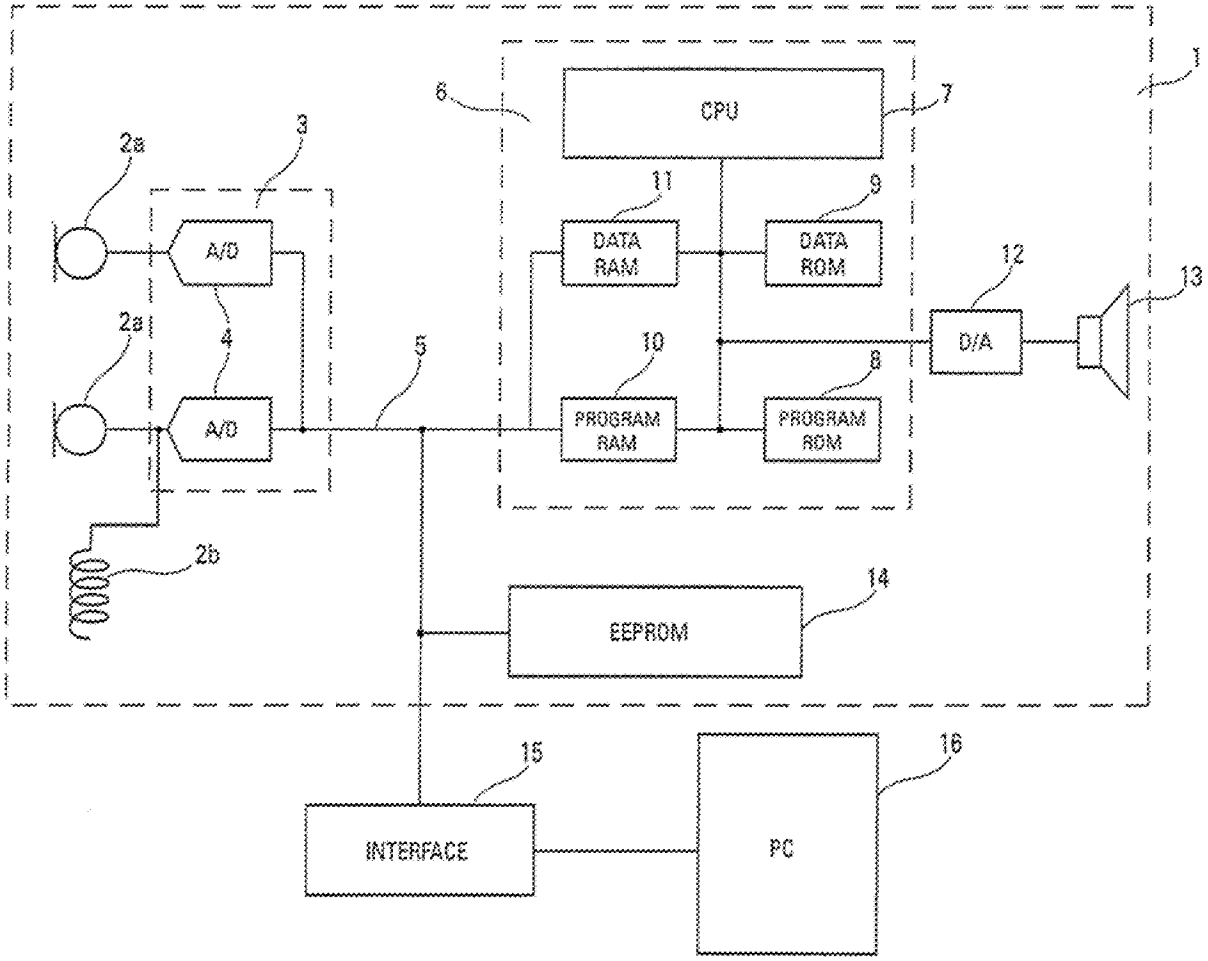
Figure 11:
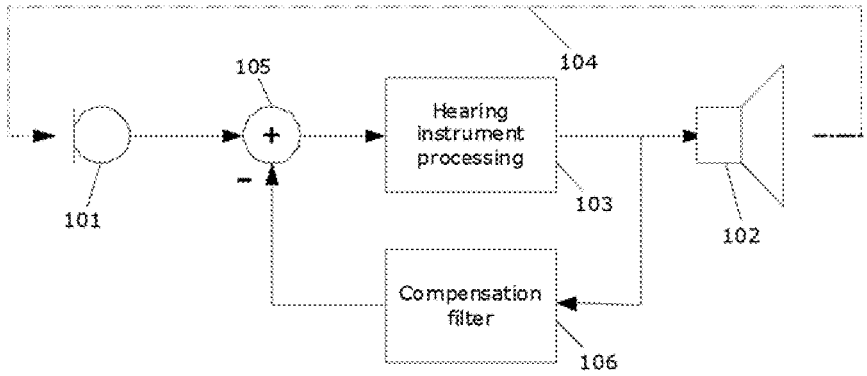

FIG. 4 illustrates the position of the hearing aid housing in the ear canal during use, FIG. 5 shows a second embodiment with an earpiece part, FIG. 6 shows the earpiece part of the embodiment of FIG. 3 in more detail, FIG. 7 shows a third embodiment with a customized part, FIG. 8 shows an embodiment with a battery door, FIG. 9 shows an embodiment with a battery door and a connector, FIG. 10 shows a simplified block diagram of a digital hearing aid enclosed in a housing according to some embodiments, and FIG. 11 shows a block-diagram of a hearing aid with one feedback compensation filter.

DETAIL DESCRIPTION

The embodiments will now be described more fully hereinafter with reference to the accompanying drawings. Like reference numerals refer to like elements throughout except in FIG. 5 wherein reference numerals 1-16 designate electronic circuits. The embodiments may, however, be embodied in different forms and should not be construed as limited to the embodiments set forth herein. Rather, these embodiments are provided so that this disclosure will be thorough and complete, and will fully convey the scope of the application to those skilled in the art. Like reference numerals refer to like elements throughout. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

Figure 1:
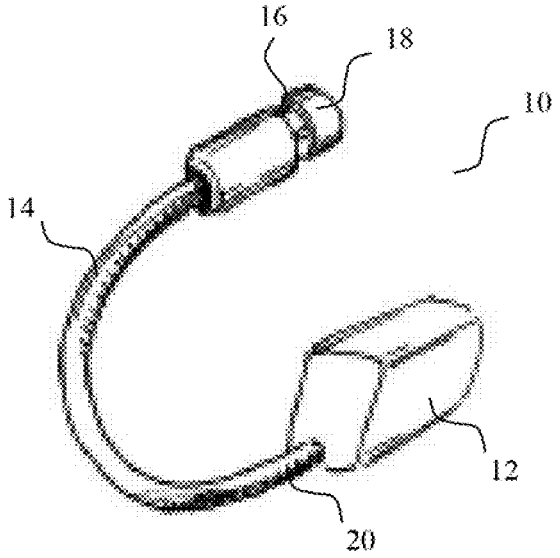
FIG. 1 is a perspective view of a first embodiment.
Figure 2:
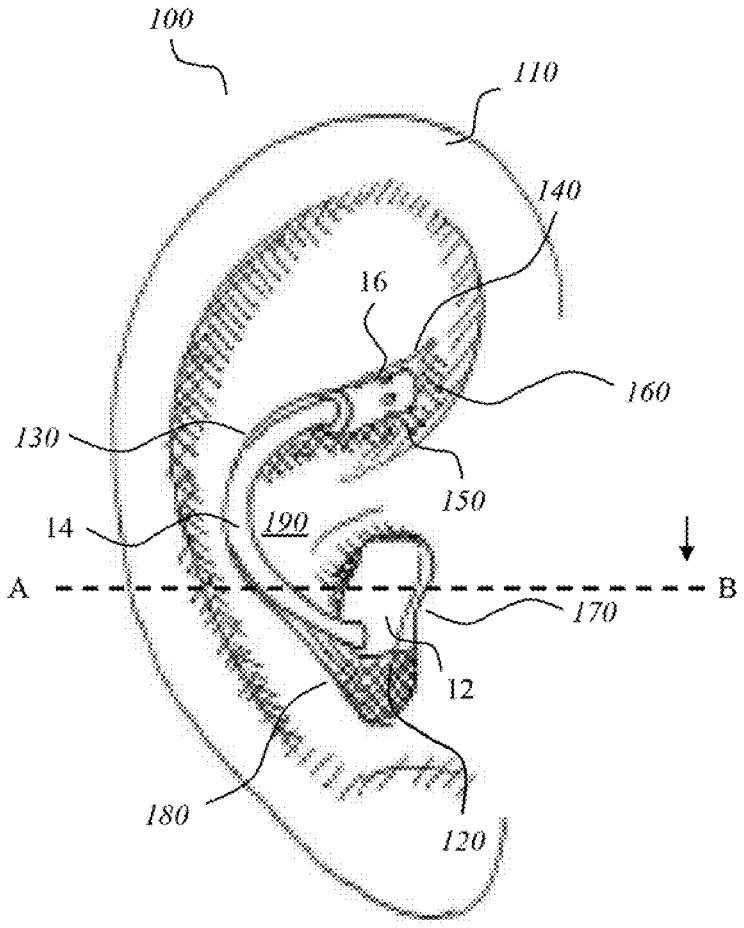
FIG. 2 shows the first embodiment positioned in the ear of a user.

FIG. 1 shows in perspective a first embodiment of a hearing aid 10. FIG. 2 shows the embodiment of FIG. 1 positioned in the ear of a user. The illustrated hearing aid 10 has a housing 12 for accommodation of hearing aid components and adapted to be positioned in the ear canal 120 of a user comfortably fitting the ear canal 120 for retention of the housing 12 in the ear of the user. The housing 12 has loudspeaker (not shown) for emission of sound through an output port (not shown) towards the eardrum of the user. The housing 12 may further have a vent (not shown) for substantially eliminating the occlusion effect when the housing 12 is inserted into the ear canal 120 of the user.

The hearing aid 10 further comprises an elongate member 14 that is attached to the housing 12 and adapted for positioning within the pinna 100 during use. More specifically, the elongate member 14 is adapted to be positioned in the cimba concha 160 of the ear of the user. In the illustrated embodiment, the elongate member 14 and the housing 12 form separate units that are manufactured in separate pieces. The microphone of the hearing aid 10 is positioned at the microphone input port 16 at the second end 18 of the elongate member 14. The housing 12 accommodates the other components. Signal conductors extend within the elongate member 14 for electrical interconnection of the microphone with the other components in the housing 12.

Positioning of the microphone(s) of the hearing aid at the second end of the elongate member 14 provides an increased distance between the microphone(s) and the output port as compared to the corresponding distance in conventional ITE and CIC hearing aid aids whereby acoustic feedback is diminished.

In the illustrated embodiment, the housing 12 and elongate member 14 are manufactured as separate parts that are removably interconnected mechanically and electrically.

The illustrated housing 12 and the elongate member 14 are manufactured in a number of respective standard sizes to fit the human anatomy of the ear of most users. In this way, the manufacturing cost is lowered as compared to the manufacturing cost of customized housings.

As illustrated in more detail in FIGS. 6 and 7, the elongate member 14 is removably interconnected with the housing 12 so that a large number of different models of the hearing aid 10 may be provided by combining elongate members 14 of different standard sizes with housings 12 of different standard sizes.

The elongate member 14 is adapted to be positioned in the concha of the pinna 100 of the user and has a longitudinal shape with a first end 20 attached to the housing 12 and an opposite second end 18.

The elongate member 14 assists in retaining the housing 12 in the ear canal 120 of the user so that the housing 12 remains securely in place in the ear canal 120 without falling out of the ear. Retention is provided without causing pain to the user. Retention of the device in the proper place is important. Jaw movements during chewing for instance can exert outward forces on the housing 12 of the hearing aid. The elongate member 14 counteracts this force thereby sufficiently securing the device 10 from outward motion.

The illustrated elongate member 14 is resilient in a direction perpendicular to its longitudinal extension thereby providing further retention capability of the housing 12 in the ear canal 120 of the user. During positioning of the housing 12 in its intended position in the ear canal 120 of the user, the transverse resilience of the elongate member 14 facilitates insertion of the housing 12 into the ear canal 120 of the user.

The elongate member 14 is adapted to abut the antihelix 130 and extend to the inferior crus 150 of the antihelix so that the second end 18 is positioned at the cimba concha 160 of the ear below the triangular fossa when the hearing aid 10 is positioned in the ear of the user.

The elongate member 14 has a larger cross-section at the second end 18 accommodating the microphone than a remaining part of the elongate member 14 extending therefrom and towards the first end 20.

The elongate member 14 may accommodate further electrical hearing aid components.

The illustrated elongate member 14 is substantially rigid in the direction of its longitudinal extension so that electrical conductors residing in the elongate member 14 are protected against breaking.

With a microphone in the elongate member 14 at its second end 18 that is positioned at the cimba concha 160 of the ear below the triangular fossa, localisation is substantially maintained since the microphone is positioned at a location within the pinna 100 wherein the received sound signal enables the user to perceive direction towards a sound source from the signal transmitted to the ear drum of the user by the hearing aid 10.

Two microphones may be accommodated at the second end 18 of the elongate member 14 for provision of noise suppression and/or further directionality.

FIG. 3 shows another embodiment of a hearing aid positioned in an ear of a user. The illustrated hearing aid may have all of the features of the hearing aid shown in FIGS. 1 and 2.

In addition to the features of the elongate member 14 shown in FIGS. 1 and 2, the elongate member shown in FIG. 3 is further adapted to abut part of the concha at the antitragus 180 when the housing 12 has been inserted in the ear canal 120 thereby applying a force to the housing towards the ear canal retaining the housing in a position in which the housing is pressed against an anatomical feature within the ear canal.

FIG. 4 shows the positioning of a the hearing aid housing in the ear canal 120 of a user. The cross-section of FIG. 4 is taken along line AB in FIG. 2 or 3. The viewing direction is indicated by the arrow. The housing 12 forms an angle along its longitudinal extension facilitating accommodation of the housing in the ear canal 120 of the user.

Preferably, the housing is flexible for variation of the angle for accommodation of the housing to different angles of different users. Preferably, the housing is flexible for comfortable accommodation of the housing in the ear canal of the user providing a high level of comfort.

The illustrated housing 12 has a cross-section that is smaller than the cross-section of the ear canal 120 so that occlusion substantially does not occur due to venting of the earpiece 42 (not shown). When the housing 12 is inserted into the user's ear canal 120, the smaller cross-section of the housing allows communication from the ear canal between the eardrum and the housing through the venting of earpiece 42 to the surroundings for prevention of occlusion. The illustrated hearing aid housing 12 is positioned completely in the ear canal of the user like a conventional CIC hearing aid. When the hearing aid housing is properly inserted into the ear canal of the user, the outward pointing end of the hearing aid housing with the battery door 60 is aligned with, or approximately aligned with, the cavum conchae 190, i.e. the battery door 60 coincides with, or approximately coincides with, the delimitation between the cavum conchae and the ear canal.

FIG. 5 illustrates an embodiment wherein the housing 12 is attached to a flexible earpiece part 30. The housing 12 extends through a central part of the flexible earpiece part 30 and is attached to the earpiece part 30. The flexible earpiece part 30 is adapted for positioning in the ear canal of the user and comprises a base 32 that is connected to the housing 12. As illustrated in more detail in FIG. 6, the flexible earpiece part has two sidewalls 34, 36 that are attached to the base 32. Each of the sidewalls 34, 36 has a respective edge 38, 40 that extends substantially from adjacent parts of the base 32 to an opening 42 of the earpiece part 30. The width of the opening 42 fits within the ear canal of the user. The ear piece walls 34, 36 abut the ear canal wall for retention of the housing 12 in the ear canal 120 so that the housing 12 does not touch the ear canal wall for maximum comfort of the user.

The base 32 of the earpiece part is sufficiently rigid and thick to carry and support the attached housing 12 and earpiece part sidewalls 34, 36 without being deformed. The sidewalls 34, 36 are made from a thin sheet of a soft and flexible material and they hold the housing 12 in an intended position within the ear canal 120 of the user. In this position, the base 32 does not touch the ear canal wall. The edges 38, 40 allow the sidewalls 34, 36 to adjust to the size and shape of the user's ear canal 120 since the edges 38, 40 may be displaced along the surface of the ear canal 120 when the earpiece part is being inserted and pressure thereby is applied to the sidewalls 34, 36 by the ear canal wall. The circumferential displacement of the edges 38, 40 allows the sidewall to adjust to the shape and size of the user's ear canal 120 without wrinkling and loosing contact with the ear canal 120 so that undesirable leaks do not occur.

The sidewalls 34, 36 are mutually overlapping so that the edge of one sidewall is covered by the other sidewall whereby only one of the edges 38, 40 is in direct contact with the skin of the ear canal 120 when the earpiece part is in use. This reduces the risk of undesired openings or leaks in the earpiece part along the edges 38, 40 of the sidewalls 34, 36.

The sidewalls 34, 36 of the earpiece part 30 impart a generally conical shape to the earpiece part 30. Thus, the earpiece part fits ear canals with cross-sections ranging between the smallest and largest cross sections of the conical sidewalls 34, 36.

As illustrated, the conical shape has a substantially elliptical cross-section. This is advantageous since an ear canal typically has a substantially oval or elliptical shape.

One of the sidewalls is thickest along the edge of the first sidewall, while the other sidewall is thinnest along the edge of the second sidewall. Thus, the first sidewall will be more rigid along its edge while the second sidewall will be softer or more flexible along the edge. If the edge of the second sidewall is positioned between the ear canal and the first sidewall, then the rigidness of the first sidewall will provide an outward pressure on the second sidewall in the direction of the ear canal surface. The flexibility of the second sidewall therefore assures close contact between itself and both of the first sidewall and the surface of the ear canal. Thereby, undesired leaks are prevented along the edges of the sidewalls as well as a close and tight fit in the ear canal.

The thinnest parts of the sidewalls are preferably about half the thickness of the thickest parts. The thinnest part may have a thickness in the range of 0.05 mm to 0.5 mm, such as in the range of 0.1 mm to 0.45 mm, such as in the range of 0.15 mm to 0.4 mm, such as in the range of 0.2 mm to 0.35 mm, such as in the range of 0.25 mm to 0.3 mm. Accordingly, the thickest part may have a thickness in the range of 0.1 mm to 1.0 mm, such as in the range of 0.2 mm to 0.9 mm, such as in the range of 0.3 mm to 0.8 mm, such as in the range of 0.4 mm to 0.7 mm, such as in the range of 0.5 mm to 0.6 mm.

Furthermore, the base may comprise a vent 44. When the earpiece part is inserted into the user's ear canal, the vent 44 provides communication between the ear canal behind the base 32 of the earpiece part 30 and the surroundings. The vent opening may be a hole in the base having a substantially circular or elliptical shape. Thereby, occlusion is prevented.

It has surprisingly been found that the earpieces illustrated in FIG. 6 may provide venting even without a vent in the base. This is believed to be due to the walls at least at the edges being sufficiently thin to be transparent to sound so that sound propagates through the earpiece in the ear canal substantially without attenuation whereby the user does not experience the occlusion effect.

The earpiece part 30 is moulded. A highly suitable material is silicone.

FIG. 7 shows an embodiment wherein the housing 12 has a customized part 50 for positioning and retention of the housing 12 in the ear canal of the user.

FIGS. 8 and 9 illustrate an embodiment of a battery door 60 of the housing 12 in more detail. The battery door 60 is provided at the proximate end of the housing 12 facing out of the ear canal when the hearing aid 10 is positioned in the ear. The battery door 60 has a compartment 62 accommodating the battery (not shown). The battery compartment 62 swings out of the housing 12 when the battery door 60 is opened whereby the battery may be exchanged with a new battery. The elongate member 14 is attached to the battery door 60 and the battery door 60 is removably attached to the housing 12 with a connector 64 comprising resilient electrical contact members 66 for electrical interconnection of signal conductors in the elongate member 14 with electrical components in the housing 12.

FIG. 10 shows a simplified block diagram of a digital hearing aid. The hearing aid 1 comprises one or more sound receivers 2, e.g. two microphones 2*a* and a telecoil 2*b*. The analogue signals for the microphones are coupled to an analogue-digital converter circuit 3, which contains an analogue-digital converter 4 for each of the microphones.

The digital signal outputs from the analogue-digital converters 4 are coupled to a common data line 5, which leads the signals to a digital signal processor (DSP) 6. The DSP is programmed to perform the necessary signal processing operations of digital signals to compensate hearing loss in accordance with the needs of the user. The DSP is further programmed for automatic adjustment of signal processing parameters in accordance with some embodiments.

The output signal is then fed to a digital-analogue converter 12, from which analogue output signals are fed to a sound transducer 13, such as a miniature loudspeaker.

In addition, externally in relation to the DSP 6, the hearing aid contains a storage unit 14, which in the example shown is an EEPROM (electronically erasable programmable read-only memory). This external memory 14, which is connected to a common serial data bus 5, can be provided via an interface 15 with programmes, data, parameters etc. entered from a PC 16, for example, when a new hearing aid is allotted to a specific user, where the hearing aid is adjusted for precisely this user, or when a user has his hearing aid updated and/or re-adjusted to the user's actual hearing loss, e.g. by an audiologist.

The DSP 6 contains a central processor (CPU) 7 and a number of internal storage units 8-11, these storage units containing data and programmes, which are presently being executed in the DSP circuit 6. The DSP 6 contains a programme-ROM (read-only memory) 8, a data-ROM 9, a programme-RAM (random access memory) 10 and a data-RAM 11. The two first-mentioned contain programmes and data which constitute permanent elements in the circuit, while the two last-mentioned contain programmes and data which can be changed or overwritten.

Typically, the external EEPROM 14 is considerably larger, e.g. 4-8 times larger, than the internal RAM, which means that certain data and programmes can be stored in the EEPROM so that they can be read into the internal RAMs for execution as required. Later, these special data and programmes may be overwritten by the normal operational data and working programmes. The external EEPROM can thus contain a series of programmes, which are used only in special cases, such as e.g. start-up programmes.

A block-diagram of an embodiment of a hearing aid with a feedback compensation filter 106 is shown in FIG. 11. The hearing aid comprises a microphone 101 for receiving incoming sound and converting it into an audio signal. A receiver 102 converts output from the hearing aid processor 103 into output sound, which in, e.g., a hearing aid is supposed to be modified to compensate for a users hearing impairment. Thus, the hearing aid processor 103 comprises elements such as amplifiers, compressors and noise reduction systems etc.

A feedback path 104 is shown as a dashed line between the receiver 102 and the microphone 101. Due to the feedback path, the microphone 101 may pick up sound from the receiver 102 which may lead to well known feedback problems, such as whistling.

The (frequency dependent) gain response (or transfer function) H(ω) of the hearing aid (without feedback compensation) is given by:

$$H(\omega) = \frac{A(\omega)}{1 - F(\omega)A(\omega)} \tag{1}$$

where ω represents (angular) frequency, F(ω) is the gain function of the feedback path 104 and A(ω) is the gain function provided by the hearing aid processor 103. The feedback compensation filter 106 is adapted to feed a compensation signal to the subtraction unit 105, whereby the compensation signal is subtracted from the audio signal provided by the microphone 101 prior to processing in the hearing aid processor 103. The transfer function now becomes:

$$H(\omega) = \frac{A(\omega)}{1 - (F(\omega) - F'(\omega))A(\omega)} \tag{2}$$

where F'(ω) is the gain function of the compensation filter 106. Thus, F'(ω) estimates the true gain function F(ω) of the feedback path, the closer H(ω) will be to the desired gain function A(ω).

As previously explained, the feedback path 104 is usually a combination of internal and external feedback paths and acoustical and mechanical feedback paths.

The invention claimed is:

1. A hearing aid comprising:

a housing for accommodation of a signal processor for processing an audio signal into a processed audio signal compensating a hearing loss, and a receiver that is connected to an output of the signal processor for converting the processed audio signal into a sound signal; and an elongate member;

wherein the housing extends through a central part of an earpiece part, and is coupled to the earpiece part, the earpiece part configured to be placed in an ear canal of a user; and wherein the housing is coupled to the elongate member, and the elongate member is configured to be placed in contact with a pinna and outside the ear canal of the user, and wherein the elongate member is shaped to abut at least a lower part of a concha that is next to an antitragus when the earpiece part to which the housing is coupled has been inserted in the ear canal.

2. The hearing aid according to claim 1, wherein the earpiece part is a customized part for positioning and retention of the housing in the ear canal of the user.

3. The hearing aid according to claim 1, wherein the earpiece part is a flexible earpiece part for positioning and retention of the housing in the ear canal of the user.

4. The hearing aid according to claim 3, wherein the flexible earpiece part has a base that is connected to the housing, the housing extending through the base.

5. The hearing aid according to claim 3, wherein the flexible earpiece part has a sidewall that is attached to the base, and an edge that extends substantially from the base to an opening of the earpiece part.

6. The hearing aid according to claim 5, wherein the sidewall is made from a thin sheet of a soft and flexible material for holding the housing in an intended position within the ear canal of the user, in which position, the base does not touch a wall of the ear canal.

7. The hearing aid according to claim 5, wherein the sidewall of the earpiece part has a generally conical shape.

8. The hearing aid according to claim 7, wherein the conical shape has a substantially elliptical cross-section.

9. The hearing aid according to claim 4, wherein the base has a vent.

10. The hearing aid according to claim 1, wherein the housing is configured to be positioned completely in the ear canal of the user.

11. The hearing aid according to claim 1, further comprising an additional housing, wherein the housing and the additional housing have different respective pre-determined sizes.

12. The hearing aid according to claim 1, further comprising an additional elongate member, wherein the elongate member and the additional elongate member have different respective pre-determined sizes.

13. The hearing aid according to claim 1, wherein the elongate member is removably attached to the housing.

14. The hearing aid according to claim 1, wherein the elongate member has a longitudinal shape with a first end attached to the housing and an opposite second end.

15. The hearing aid according to claim 1, wherein the elongate member is configured to abut an antihelix and extends at least to an inferior crus of the antihelix during use.

16. The hearing aid according to claim 15, wherein the second end is located below a triangular fossa of the user during use.

17. The hearing aid according to claim 1, wherein the elongate member is shaped to apply a force to the housing towards the ear canal for retaining the housing in a position in which the housing is pressed against an anatomical feature within the ear canal when the earpiece part to which the housing is coupled has been inserted in the ear canal, and when the earpiece part abuts the lower part of the concha that is next to the antitragus.

18. The hearing aid according to claim 1, wherein the elongate member is flexible and preformed.

19. The hearing aid according to claim 1, wherein the elongate member is substantially rigid in its longitudinal direction.

20. The hearing aid according to claim 1, wherein the elongate member is configured for accommodation of a microphone.

21. The hearing aid according to claim 20, wherein the elongate member has a longitudinal shape with a first end attached to the housing, and wherein a part of the elongate member for accommodation of the microphone has a larger cross-section than a remaining part of the elongate member extending therefrom towards the first end.

22. The hearing aid according to claim 1, further comprising a battery door removably attached to the housing, wherein the elongate member is directly attached to the battery door and indirectly attached to the housing.

23. The hearing aid according to claim 22, wherein the housing further comprises a connector for making an electrical contact with a signal line in the elongate member when the battery door is attached to the housing.

24. The hearing aid according claim 1, wherein the housing forms an angle along its longitudinal extension for facilitating accommodation of the housing in the ear canal of the user.

25. The hearing aid according to claim 24, wherein the housing is flexible for variation of the angle.

26. The hearing aid according to claim 1, further comprising a cerumen filter that is configured to be fitted on a loudspeaker with a snap on coupling, wherein the cerumen filter is coupled to the housing.

27. The hearing aid according to any of the preceding claims, further comprising a tinnitus relieving circuit that is provided with the housing.

28. The hearing aid of claim 1, wherein the elongate member is elastic.

29. The hearing aid of claim 1, wherein the elongate member has a smooth curvilinear segment that comprises a majority of an entire length of the elongate member and that extends from the housing.

30. A hearing aid, comprising:

a hearing aid housing;

a flexible earpiece part for positioning completely in an ear canal of a user, comprising a base with a first opening for accommodation of the hearing aid housing that extends through the first opening, the hearing aid housing accommodating a processor and a receiver, and at least one sidewall that is attached to the base and has an edge that extends substantially from the base to a second opening of the earpiece, the width of the second opening being less than a width of the ear canal of the user when the at least one sidewall is inside the ear canal; and an elongate member coupled to the housing, the elongate member configured to be placed in contact with a pinna and outside the ear canal of the user, wherein the elongate member is shaped to abut at least a lower part of a concha that is next to an antitragus when the earpiece part is coupled to the housing and has been inserted in the ear canal.

31. The hearing aid of claim 30, wherein the elongate member is elastic.

32. The hearing aid of claim 30, wherein the elongate member has a smooth curvilinear segment that comprises a majority of an entire length of the elongate member and that extends from the housing.

* * * * *